US011229993B2

(12) United States Patent
Landon et al.

(10) Patent No.: US 11,229,993 B2
(45) Date of Patent: Jan. 25, 2022

(54) HIGH TORQUE TOOL

(71) Applicant: AIMCO, Portland, OR (US)

(72) Inventors: Christopher Landon, Portland, OR (US); Johann Sonntag, Portland, OR (US); Benjamin Belli, Portland, OR (US); Michael Juliano, Portland, OR (US); Thomas Burnett, Portland, OR (US); Kenneth Arnell, Portland, OR (US); Len Demchak, Portland, OR (US)

(73) Assignee: AIMCO, Portland, OR (US)

( * ) Notice: Subject to any disclaimer, the term of this patent is extended or adjusted under 35 U.S.C. 154(b) by 268 days.

(21) Appl. No.: 16/659,529

(22) Filed: Oct. 21, 2019

(65) Prior Publication Data

US 2021/0114187 A1 Apr. 22, 2021

(51) Int. Cl.

| | |
|---|---|
| ***B25B 21/00*** | (2006.01) |
| ***B25B 23/16*** | (2006.01) |
| ***B25B 23/147*** | (2006.01) |

(52) U.S. Cl.
CPC ..... *B25B 21/002* (2013.01); *B25B 23/147* (2013.01); *B25B 23/16* (2013.01)

(58) Field of Classification Search
CPC ..... B25B 21/00; B25B 21/002; B25B 23/147; B25B 23/16
See application file for complete search history.

*Primary Examiner* — David B. Thomas
(74) *Attorney, Agent, or Firm* — Schwabe, Williamson & Wyatt, P.C.

(57) ABSTRACT

An apparatus for precisely measuring and applying torque and angle of rotation to tighten screwed fasteners. The apparatus includes a drive motor for generating a rotation, a pair of spaced triggers for activating the operation of the drive motor, and a controller for precisely measuring the torque to be applied and angle of rotation to be achieved by the apparatus, the controller not permitting the motor to be activated without both of the triggers being activated. A reduction gear system is also provided for reducing a rate of rotation generated by the motor, the reduction gear system outputting a rotational drive torque for driving the screwed fastener.

11 Claims, 11 Drawing Sheets

HIGH TORQUE TOOL

TECHNICAL FIELD

Embodiments herein relate to the tightening of fasteners using high torque tools in which the amount of torque and angle of rotation can be accurately measured and controlled.

BACKGROUND

Systems for tightening fasteners in settings that require the accurate application and measurement of the amount of torque have been around for many years. However, as fasteners have gotten larger, with the requirement that such fasteners can withstand increasing forces, it has become increasingly difficult to develop systems to tighten such fasteners in a manner in which they are tightened to the maximum degree of tightness without damaging the fastener or without risking the safety of the operator.

In order to satisfy such conditions, various companies, including Aimco-Global, Inc., have begun to incorporate built-in transducers that can accurately calculate and apply the ideal amount of torque. As fastener systems have gotten larger, such as those used in wind turbines, shipbuilding, pipelines and building construction, the need to precisely measure and apply torque, and calculate the angle or amount of rotation of the fastener, has become more challenging. Such measurement and application is ideally independent of the temperature and other ambient conditions in which such tools are utilized. Also, the need to make such systems useable by those of normal or even limited strength has become more pronounced. And, as such systems wear, the precision capability of the system should not be compromised. Finally, and perhaps most importantly, it is critical that such system be capable of being operated in a safe manner without risking injury to the worker using the tools.

Some such systems used so-called transducerized closed loop systems. Such systems not only include integral transducers but also include circuit boards to provide appropriate real-time date to the worker, and controllers to protect the worker while precisely and quickly performing fastening operations.

BRIEF DESCRIPTION OF THE DRAWINGS

Embodiments will be readily understood by the following detailed description in conjunction with the accompanying drawings and the appended claims. Embodiments are illustrated by way of example and not by way of limitation in the figures.

DETAILED DESCRIPTION OF DISCLOSED EMBODIMENTS

Figure 1:
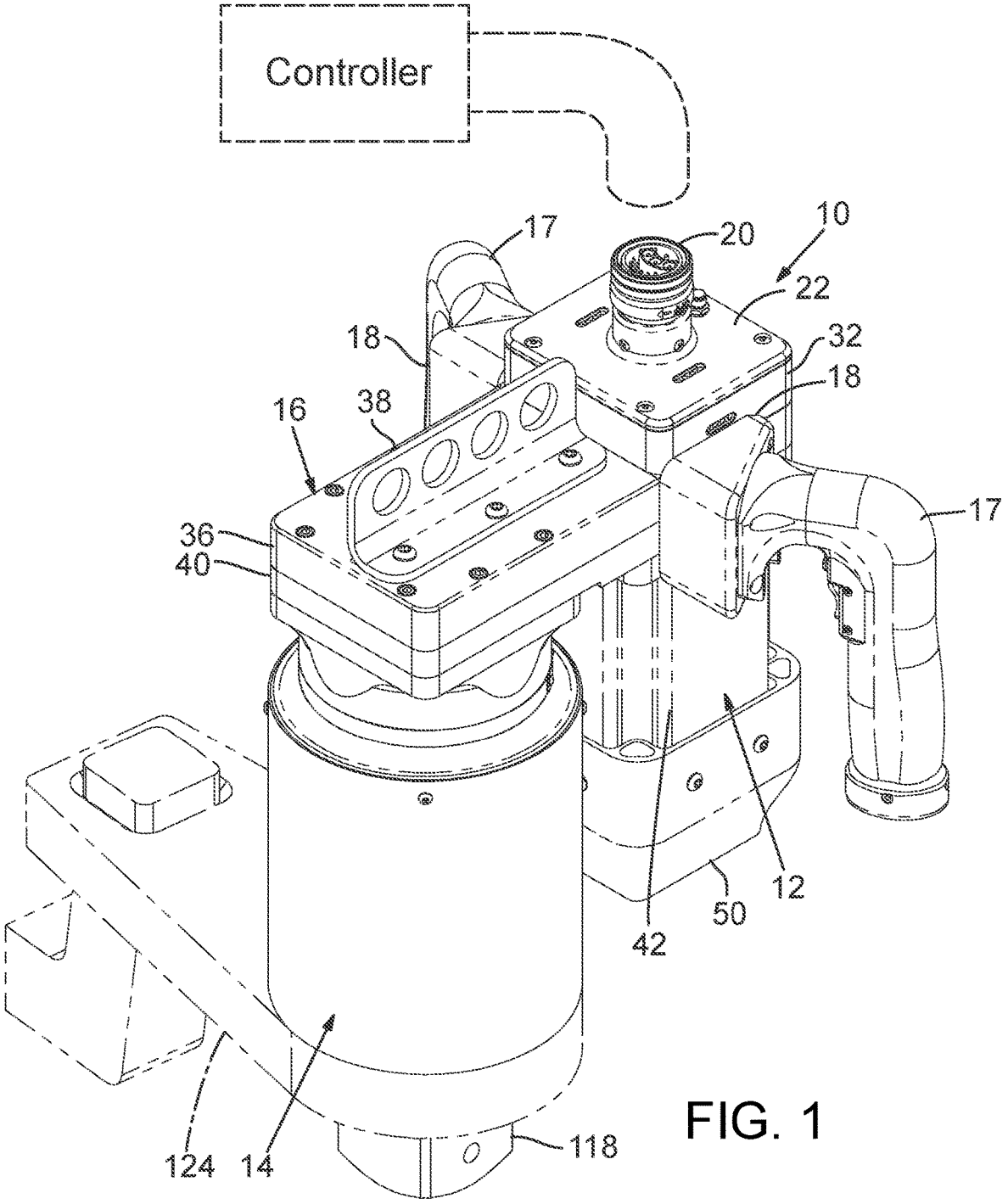
FIG. 1 is a perspective view of an embodiment taken from an upper angle, with a reaction bar shown in phantom.

In the following detailed description, reference is made to the accompanying drawings which form a part hereof, and in which are shown by way of illustration embodiments that may be practiced. It is to be understood that other embodiments may be utilized and structural or logical changes may be made without departing from the scope. Therefore, the following detailed description is not to be taken in a limiting sense.

Various operations may be described as multiple discrete operations in turn, in a manner that may be helpful in understanding embodiments; however, the order of description should not be construed to imply that these operations are order-dependent.

The description may use perspective-based descriptions such as up/down, back/front, and top/bottom. Such descriptions are merely used to facilitate the discussion and are not intended to restrict the application of disclosed embodiments.

The terms "coupled" and "connected," along with their derivatives, may be used. It should be understood that these terms are not intended as synonyms for each other. Rather, in particular embodiments, "connected" may be used to indicate that two or more elements are in direct physical or electrical contact with each other. "Coupled" may mean that two or more elements are in direct physical or electrical contact. However, "coupled" may also mean that two or more elements are not in direct contact with each other, but yet still cooperate or interact with each other.

For the purposes of the description, a phrase in the form "A/B" or in the form "A and/or B" means (A), (B), or (A and B). For the purposes of the description, a phrase in the form "at least one of A, B, and C" means (A), (B), (C), (A and B), (A and C), (B and C), or (A, B and C). For the purposes of the description, a phrase in the form "(A)B" means (B) or (AB) that is, A is an optional element.

The description may use the terms "embodiment" or "embodiments," which may each refer to one or more of the same or different embodiments. Furthermore, the terms "comprising," "including," "having," and the like, as used with respect to embodiments, are synonymous, and are generally intended as "open" terms (e.g., the term "including" should be interpreted as "including but not limited to," the term "having" should be interpreted as "having at least," the term "includes" should be interpreted as "includes but is not limited to," etc.).

With respect to the use of any plural and/or singular terms herein, those having skill in the art can translate from the plural to the singular and/or from the singular to the plural as is appropriate to the context and/or application. The various singular/plural permutations may be expressly set forth herein for sake of clarity.

Embodiments herein provide a generally U-shaped, dual handle high torque tightening tool used to manipulate a wide variety of fasteners, but typically nuts or bolts. The term "high torque" may be measured in newton-meters ("Nm"), and may be measured anywhere from 250 Nm up to 17,000 Nm or more. Such apparatus are normally handled by a single worker holding the tool.

The depicted embodiment provides an apparatus for precisely measuring and applying torque and angle of rotation to tighten screwed fasteners. The apparatus includes a drive motor for generating a rotation, a pair of spaced triggers for activating the operation of the drive motor, and a controller for precisely measuring the torque to be applied and angle of rotation to be achieved by the apparatus, the controller not permitting the motor to be activated without both of the triggers being activated. A reduction gear system is also provided for reducing a rate of rotation generated by the motor, the reduction gear system outputting a rotational drive torque for driving the screwed fastener.

Each of the two triggers may be disposed on one of two drive handles, and the two drive handles may be generally vertically-extending.

The reduction gear system may include at least one generally laterally-extending transfer gear and a generally vertically-extending planetary gear system.

The triggers may be activated by being contacted by the hands of an operator.

Another aspect of the disclosure includes a drive motor having a substantially vertically-extending drive motor drive member. A pair of spaced handles are mounted to two sides of the drive motor. A laterally-extending geared portion is drivingly connected to the drive motor drive member for reducing a rate of rotation and includes a generally vertically-extending gear drive member. A generally vertically-extending planetary reduction gear receives a rotational drive from the gear drive member and outputs a slower drive for driving the screw fastener.

The apparatus may be generally U-shaped, with the drive motor and the reduction gear making up legs of the U and the geared portion making up a connector for the legs. The term "U-shaped" should be understood to encompass apparatus that define a generally upright or a generally inverted U, although the normal configuration is that it is generally in the shape of an inverted U.

The handles typically extend generally in a vertical direction.

The apparatus may provide a 17,000 Nm drive, a 12,000 Nm drive, or a substantially greater or lesser drive.

As with most such tools, the depicted tool, indicated generally at 10, includes a high torque motor assembly 12 and a gear box assembly 14 drivingly mounted to each other by transfer gearing, indicated generally at 16. As noted, the depicted tool 10 is generally U-shaped, with motor assembly 12 and gear box assembly 14 making up the legs of the U, and the transfer gearing making up the base of the U. In its normal operation, the U is inverted, although that may not always be the case.

A pair of handles 17 may be included, and are typically identical in construction although they may include different triggers 19 to control the operation of the tool. Handles 17 may be mounted to motor 12 by a pair of angled mounting plates 18 that incline the handles toward each other for maximum comfort and leverage by the operator. The triggers typically have to both be activated, such as by being depressed, in order for a controller to activate the motor assembly 12, although sensors may be provided that sense that the operator has a hand on each handle 17. Thus, the system can be described as a closed loop system which normally cannot be activated unless both triggers 19 are activated. This ensures that the apparatus will not be activated without the operators two hands both engaging triggers 19, thereby dramatically decreasing the likelihood of injury to the hands of the operator.

Figure 8:
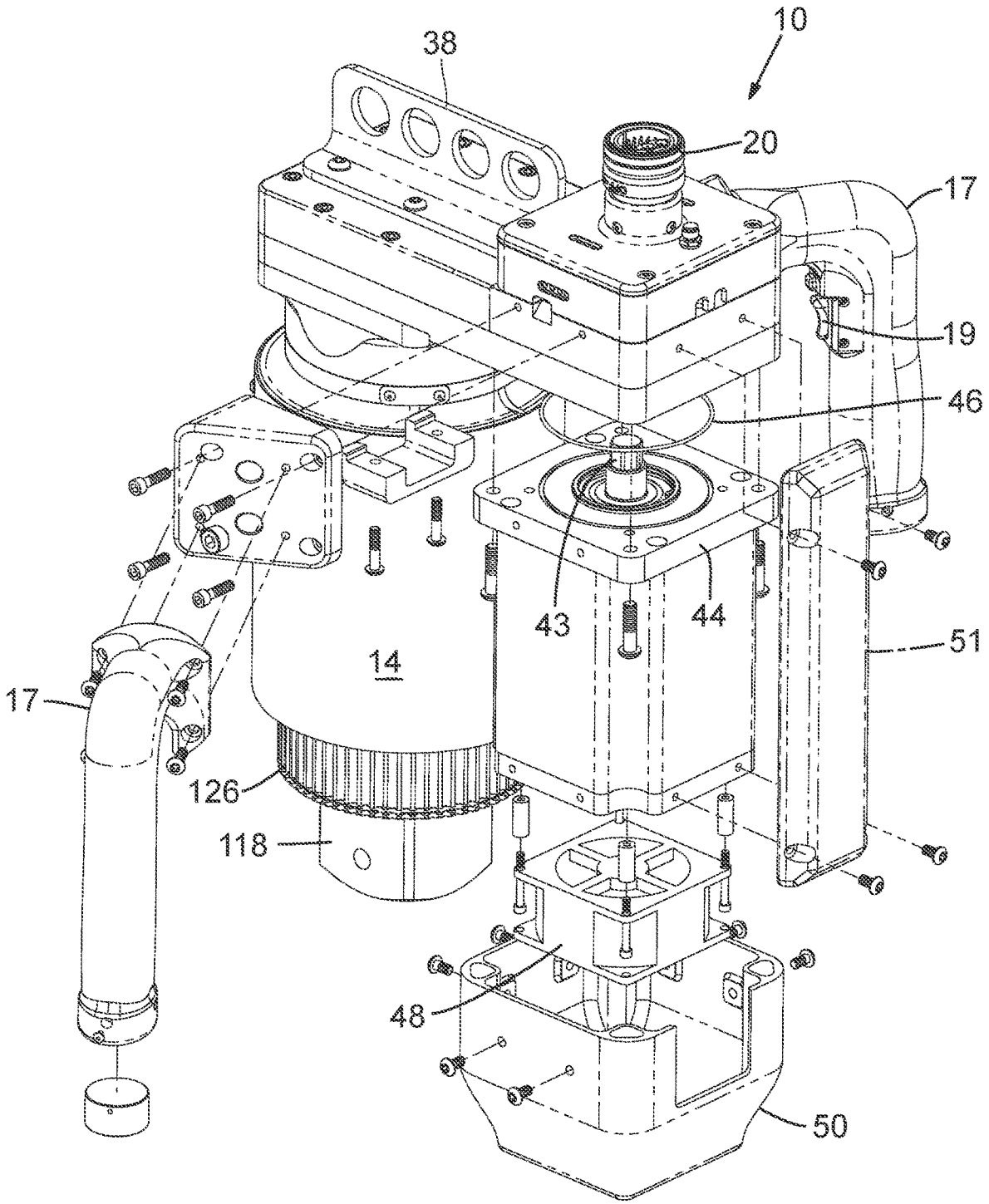
FIG. 8 is a perspective, partially exploded view of the depicted embodiment.
Figure 9:
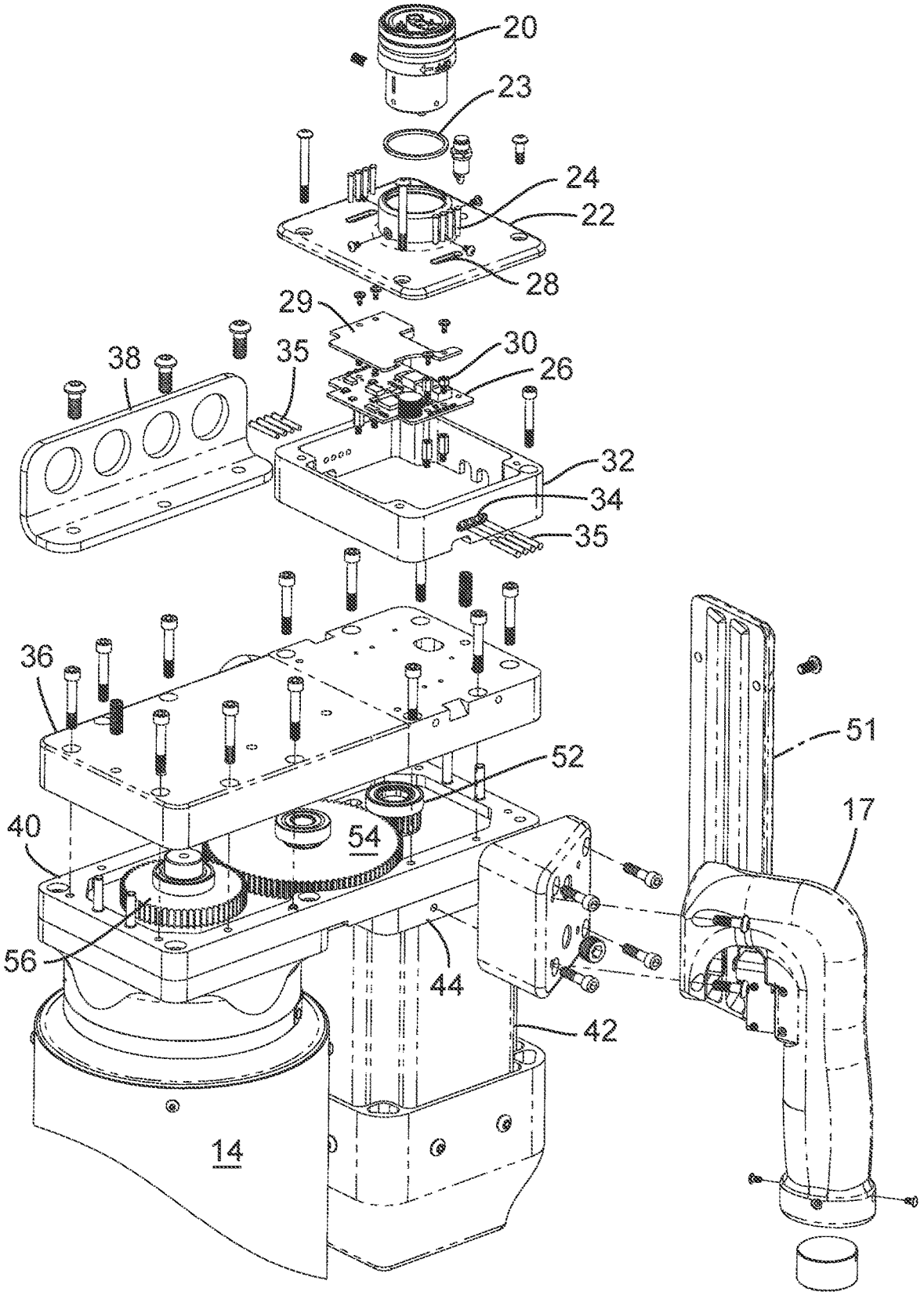
FIG. 9 is a perspective, partially exploded view of an upper portion of the depicted embodiment.

Motor assembly 12 is shown in exploded form in FIGS. 8 and 9. Beginning at the top, a tool cable connector 20 is provided to mount apparatus 10 to a tool controller, which provides power to the tool, controls the torque and degree of rotation being applied, and takes the data that the tool measures, again, such as the torque being applied and the degree of rotation of the tool and the fastener it is tightening. If desirable, the controller can send that data to other systems and the facility where the apparatus is being used. Tool cable connector 20 is mounted to an enclosure cover 22, with a sealing O-ring 23. A series of so-called light pipes 24 are mounted to a circuit board 26 via a pair of slots 28. These light pipes 24, mounted to a circuit board 26, provide information to the operator, such as whether the appropriate amount of torque and rotation is being applied, whether the cycle has been completed, or whether there is a problem with the operation. A wire insulator in the form of a panel 29 is disposed between enclosure cover 22 and tool ID board 26, and is spaced from the board by a pair of stand-offs 30. Tool ID board 26 provides data back to the controller. An enclosure 32 surrounds and protects circuit board 26 and includes a series of holes 34 on each side designed to receive a plurality of additional light pipes 35 to again provide status information to the operator.

A plurality of bolts mount enclosure 32 to a transfer gear housing cover 36. A lifting plate 38 may be included, which would also be mounted by bolts to transfer gear housing cover 36. The transfer gear cover is in turn bolted to a transfer gear housing base 40.

Motor assembly 12 includes a motor housing 42 having a motor mounting flange 44 at an upper end for mounting to transfer gear housing base 40. An O-ring 46 is typically provided to help seal the assembly. A high torque motor of conventional design is positioned in motor housing 42, driving a motor drive shaft 43. As shown in FIG. 8, also disposed in the motor housing at the lower end thereof is a motor fan 48, to which is fitted a fan housing 50. A tray 52 is typically bolted to motor housing 42 and transfer gear cover 36 to protect any external wiring that might otherwise be exposed, such as phase and Hall wiring for the motor and wiring for motor fan 48.

As shown best in FIG. 9, the mounting of transfer gear housing cover 36 to transfer gear housing base 40 defines a space in which the so-called transfer gears are mounted. These gears include a pinion 52, which is typically directly driven by motor drive shaft 43. Pinion 52 normally drives an enlarged transfer gear 54, which in turn drives a medium-sized drive gear 56. This series of gears slows down the rotation of the motor to reduce the amount of speed reduction that needs to take place in the gear box.

Figure 10:
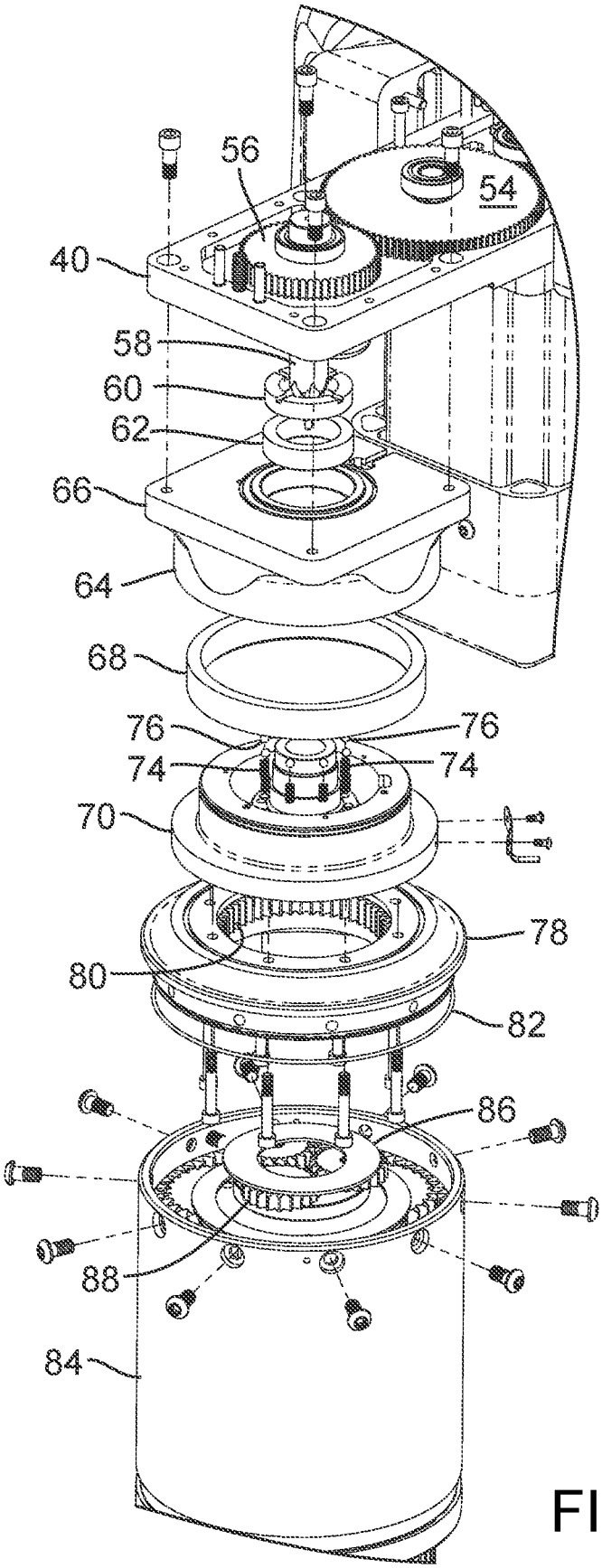
FIG. 10 is a perspective, exploded view of the transfer gearing and the upper portion of the gear box assembly.
Figure 11:
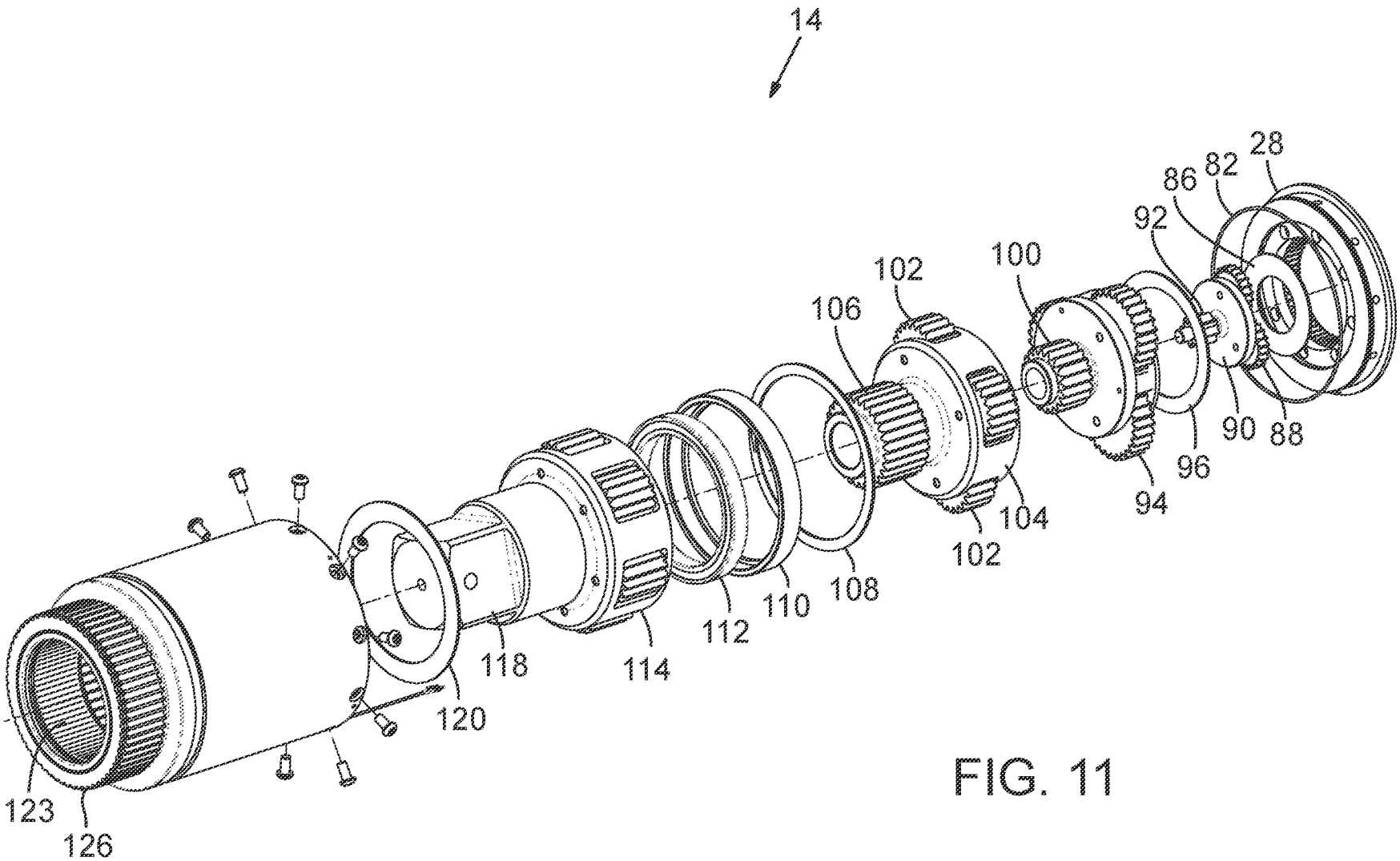
FIG. 11 is a perspective, exploded view of the gear box assembly.
Figure 13:
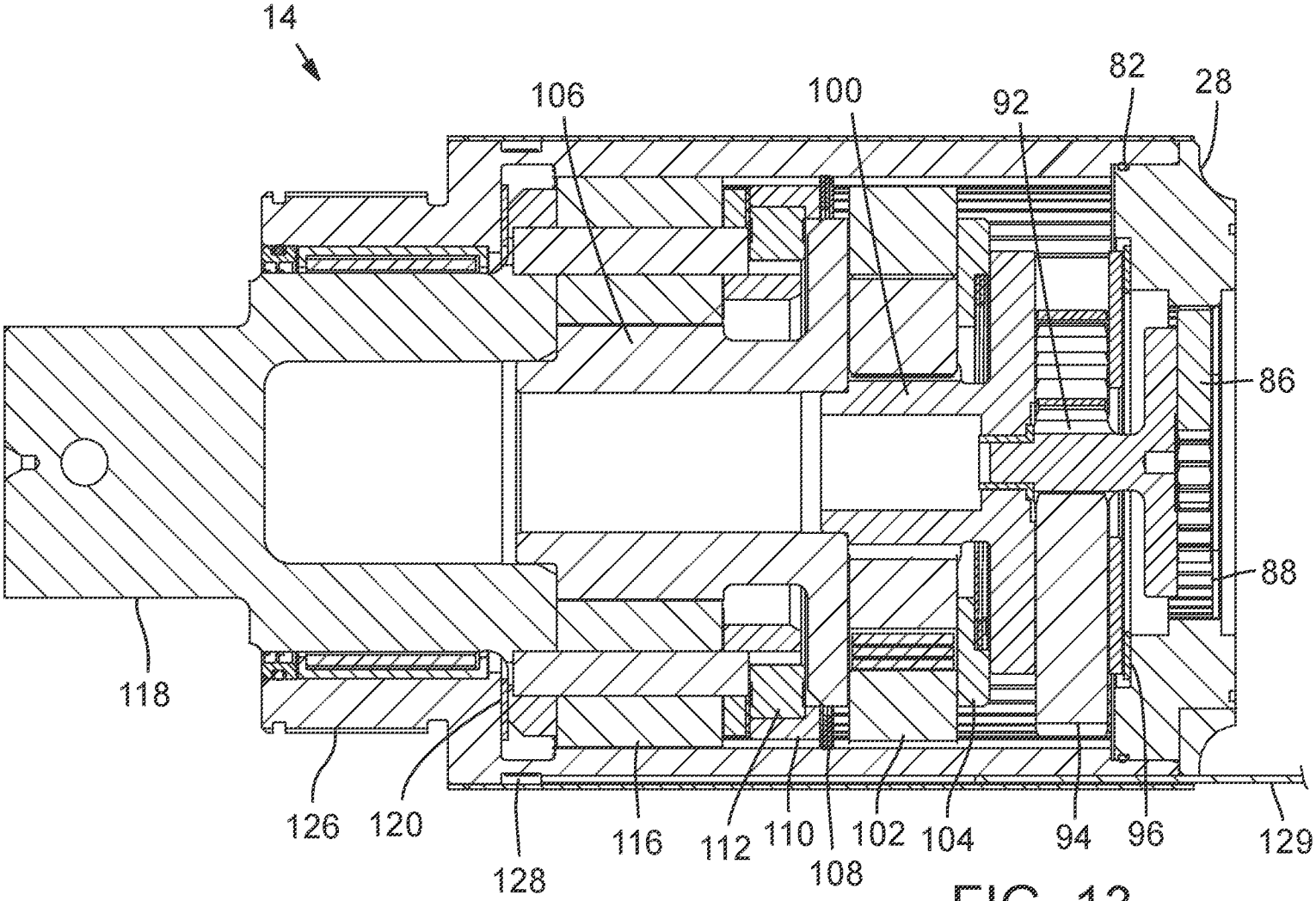
FIG. 13 is a side elevation sectional view of the gear box assembly, taken along line 13-13 of FIG. 12

Gear box assembly 14 provides a fairly conventional multi-stage epicyclic or planetary gear system, which is best shown in exploded FIGS. 10 and 11 and side elevation sectional FIG. 13. Gear box drive gear 56 includes a downwardly extending spindle 58, which extends through an inner bearing retainer 60 and an inner support bushing 62. Inner bearing retainer 60 and inner support bushing 62 fit into an annular downwardly-extending portion 64 of a gear box support flange 66, which is bolted to the underside of transfer gear housing base 40. A slip ring outer support bushing 68 fits into downwardly extending portion 64 and surrounds a slip ring inner plate 70. Inner support bushing 62 fits to an inner side of slip ring inner plate 70.

Disposed within slip ring inner plate 70 are inner annular member 62, which supports a plurality of compression springs 74 (here 8) and a corresponding number of detent balls 76. Detent balls 76 are held against complementing slots (not shown) in the downwardly extending portion 64 of gear box support flange. These detents provide a limited amount of play in the reaction bar before full torque is applied to the fastener.

Slip ring inner plate 70 is bolted to a first stage ring gear housing 78 carrying first stage ring gear 80. An external O-ring 82 surrounds ring gear housing 78 as it fits into a gear box housing 84. A first stage thrust washer 86 is disposed above three first stage planet gears 88, which are mounted to a first stage planet gear carrier 90. A first stage sun gear 92 extends downwardly from first stage planet carrier 90, and meshes with second stage planet gears 94 after passing a second stage thrust washer 96. Second stage planet gears 94 are mounted to a second stage carrier 98, to which is mounted a second stage sun gear 100.

The second stage sun gear 100 drives a set of third stage planet gears 102, which drive a third stage carrier 104, to which is mounted a third stage sun gear 106. A spiral retaining ring 108 is mounted to third stage carrier 104 and is positioned against a first and a second fourth stage carrier rings, 110 and 112, respectively. These carrier rings are mounted to a fourth stage carrier 114, to which are mounted fourth stage planet gears 116.

Figure 12:
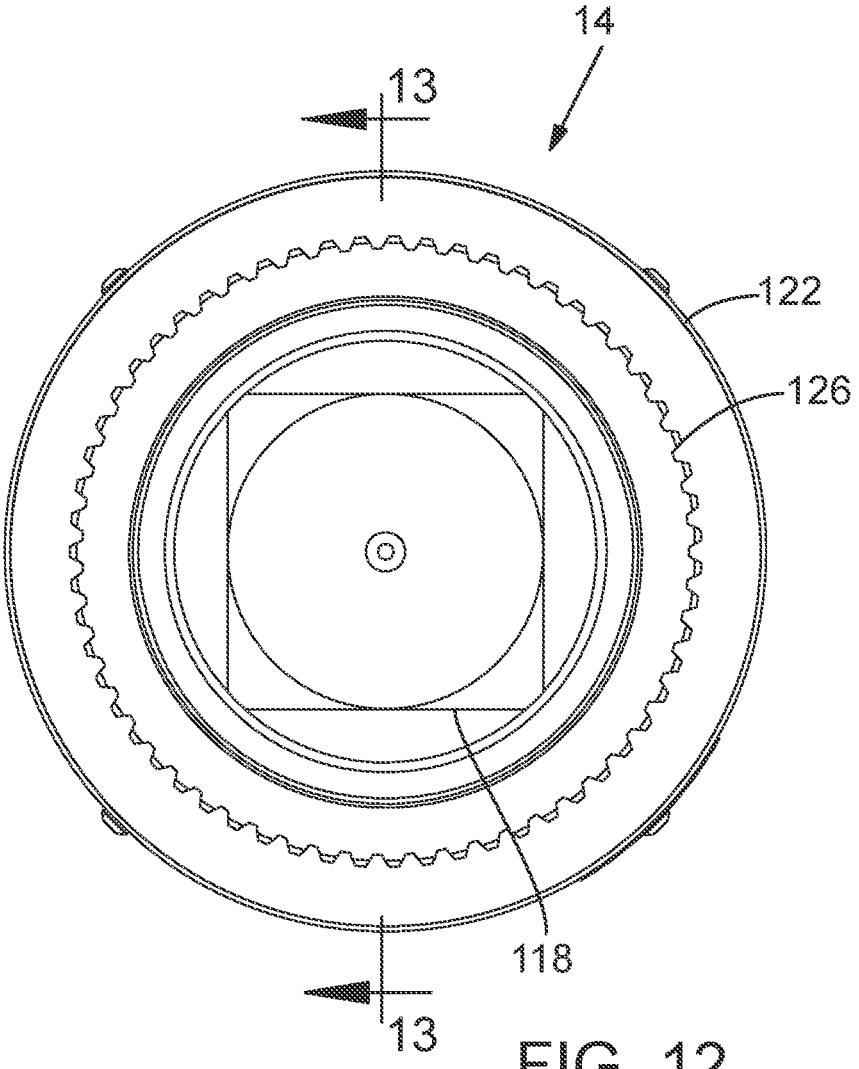
FIG. 12 is an end elevation view taken from the underside of the gear box assembly.

Extending from fourth stage carrier 114 is a drive member 118, which is usually square in cross section, but could be any configuration, depending upon the shape of the fastener being tightened. A fourth stage thrust washer 120 is positioned between fourth stage carrier 114 and a fourth stage ring gear 122 (shown in FIGS. 12 and 13). FIG. 11 shows an output bearing 123, which is pressed into fourth stage ring gear 122 before fourth stage planet gears 116 are assembled into the ring gear.

Figure 2:
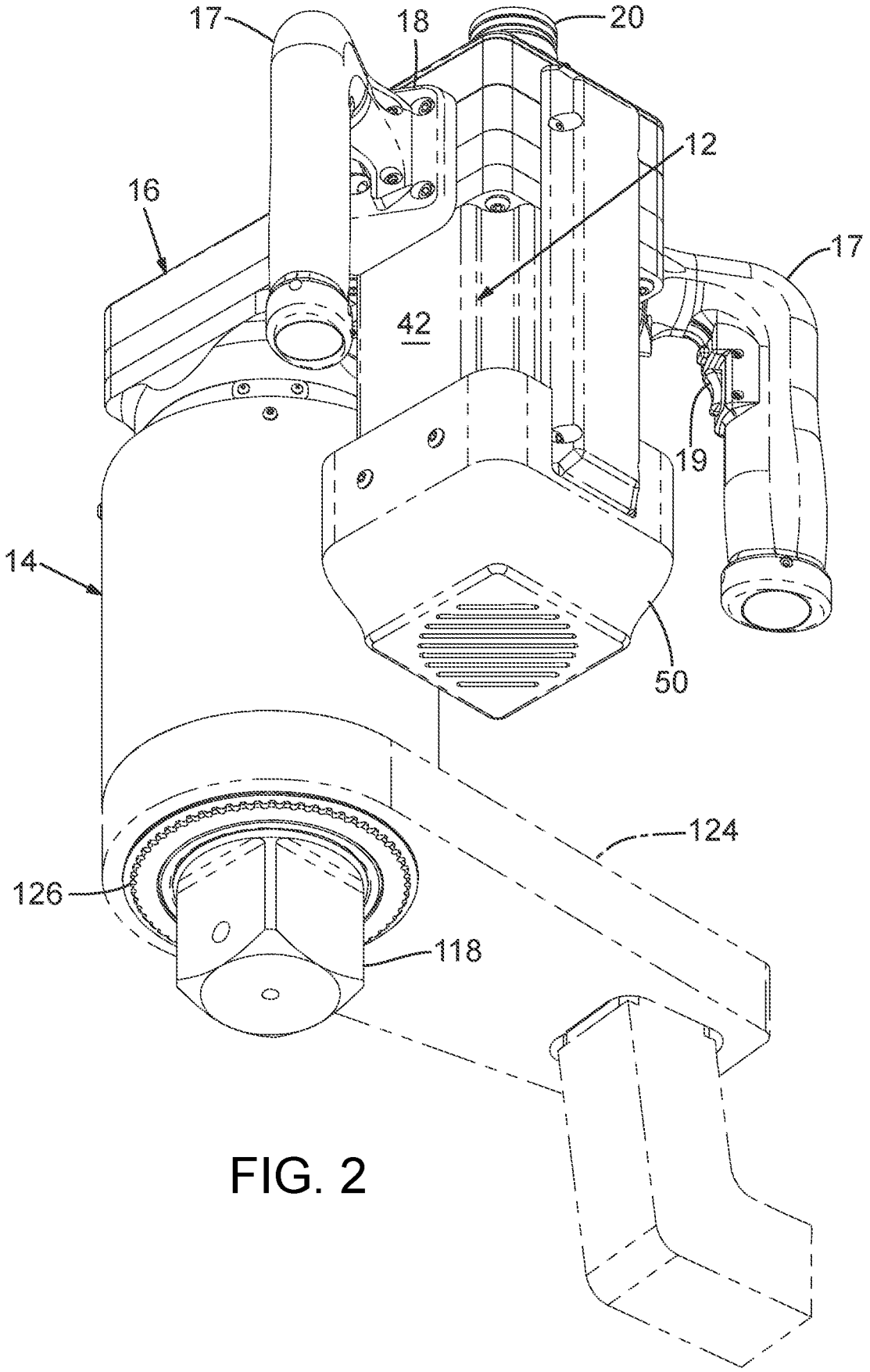
FIG. 2 is a perspective view of the depicted embodiment, taken from a lower angle.
Figure 3:
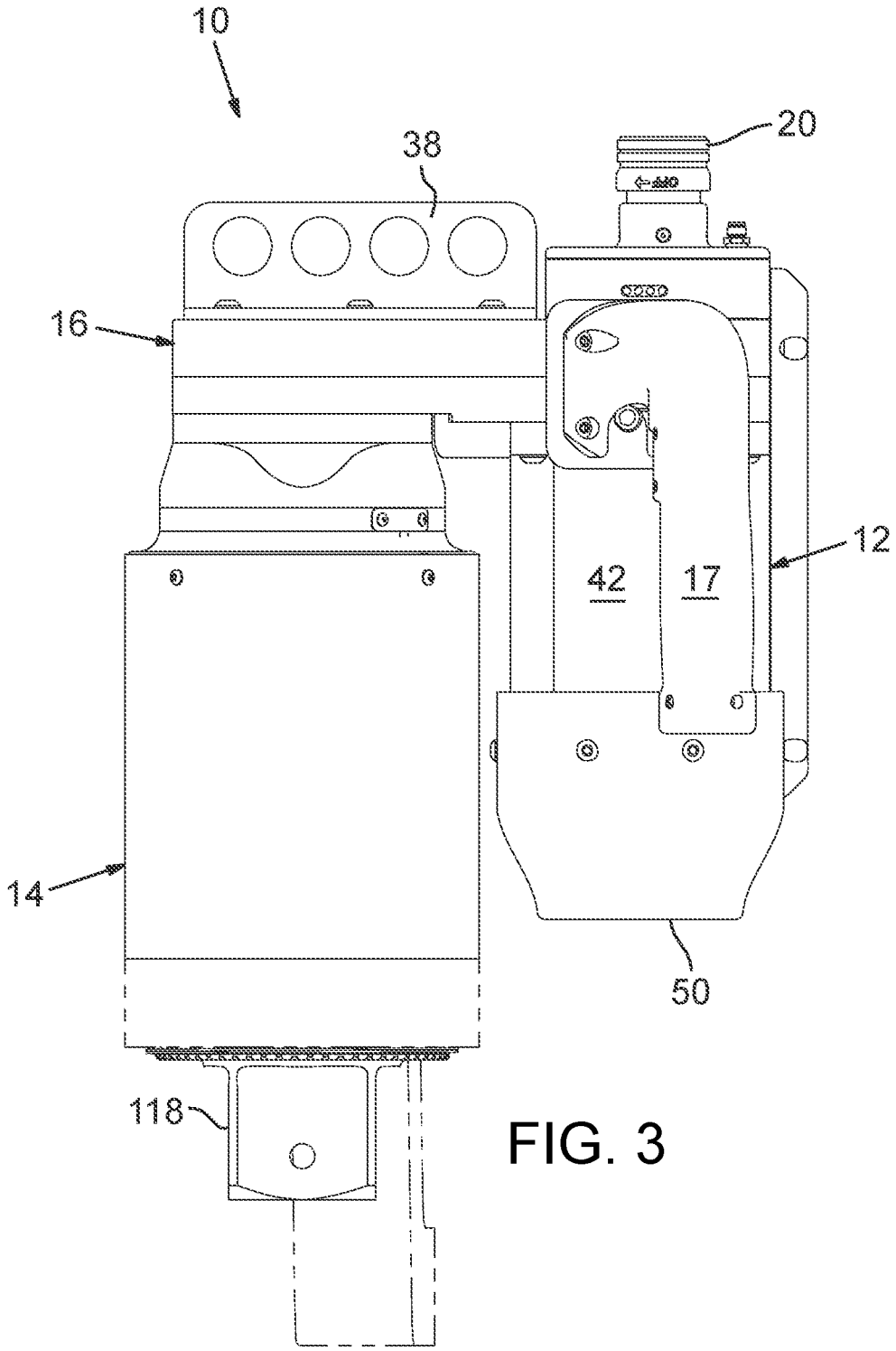
FIG. 3 is a side elevation view of the depicted embodiment.
Figure 4:
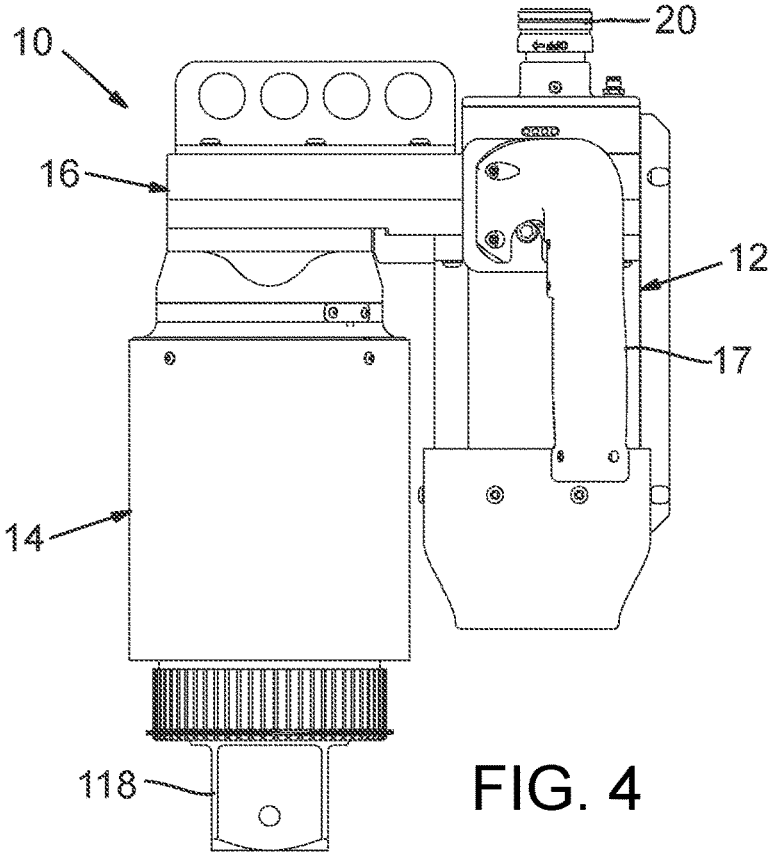
FIG. 4 is a side elevation view corresponding to FIG. 3 except that the reaction bar has been removed, exposing a reaction spline to which the reaction bar will be mounted.
Figure 5:
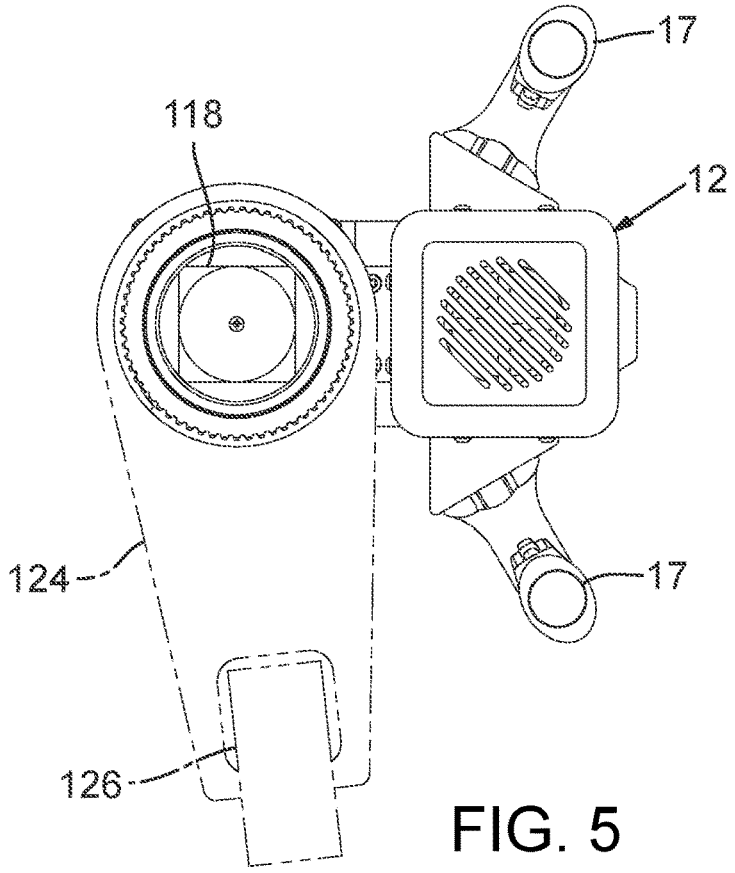
FIG. 5 is an end elevation view taken from the underside of the depicted embodiment.
Figure 6:
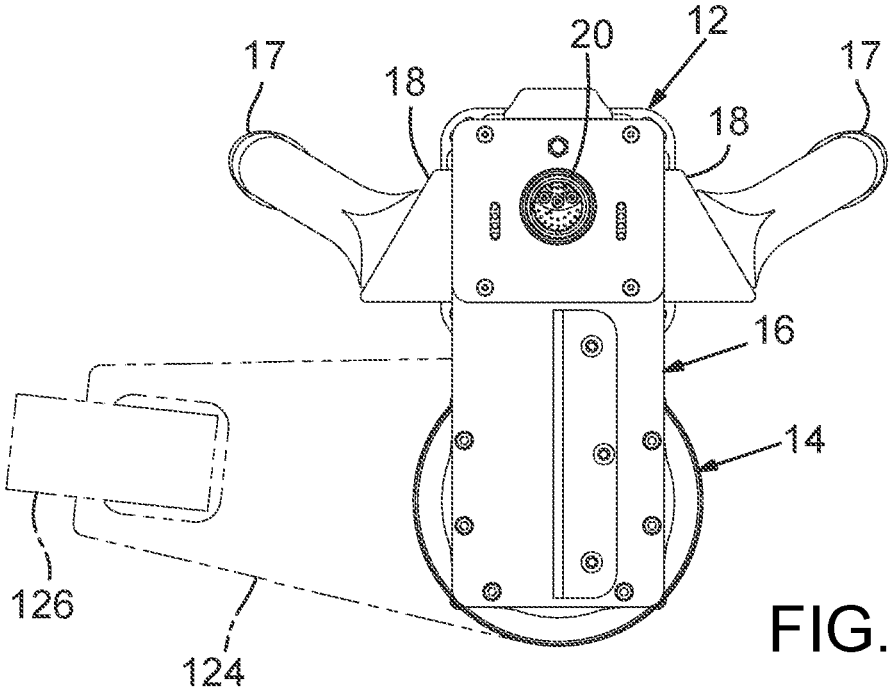
FIG. 6 is an end elevation view taken from the top of the depicted embodiment.
Figure 7:
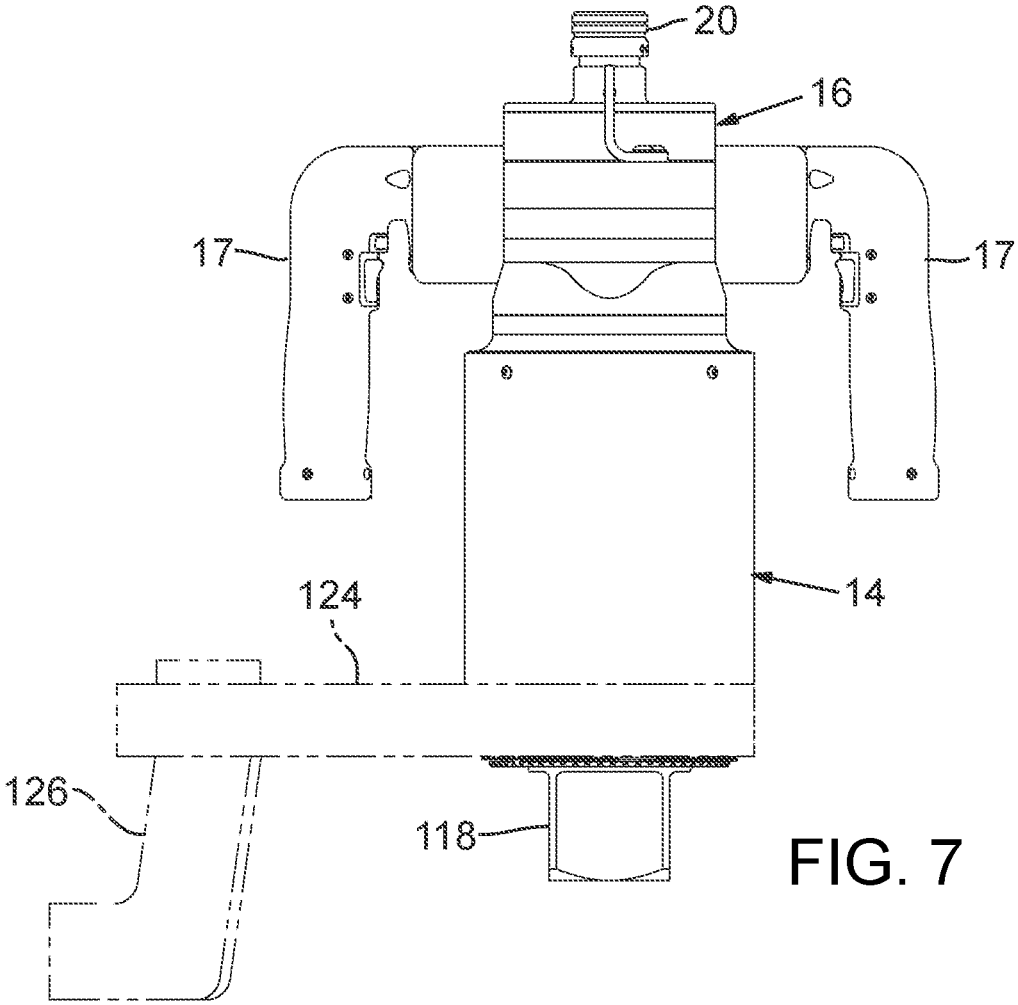
FIG. 7 is a side elevation view offset by 90 degrees from that of FIGS. 3 and 4.

Drive member 118 drives a bolt or a wide variety of other rotational fasteners, with fittings (not shown) mounted to the fastener, such as a nut (also not shown) to be turned. A reaction bar 124 absorbs reactive forces and will swing against an adjacent component such as another bolt to prevent the apparatus from rotating under the torque generated by the apparatus. Reaction bar 124 is internally-splined to facilitate mounting to an externally-splined reaction spline 126, shown in FIGS. 2, 4 and 8.

As shown best in FIG. 13, a transducer having strain gauges 128 is provided to measure torque so that the torque being applied to the immediately adjacent drive member 118 can be precisely measured. This data is transmitted to a circuit board disposed adjacent slip ring inner plate 70 and will ultimately be transmitted to the controller.

It can be seen that with apparatus 10 taking the generally U-shaped configuration, with handles 17 disposed at either side of drive motor 12, the operator can control the apparatus. As noted above, triggers 19 or some sensing system on each of the handles prevent drive motor 12 from being activated unless the operator is holding both of the handles. This ensures not only that the operator will fully control the apparatus but will ensure that the operator's hands are out of the way. Without this feature, it may be possible for operators to pinch their hands or fingers in or between reaction bar 124 or lever 126.

PARTS LIST

10 tool generally
12 drive motor
14 gear box assembly
16 transfer gear generally
17 handles
18 angled mounting plates
19 triggers
20 tool cable connector
22 enclosure cover
23 O-ring
24 light pipes
26 tool ID board
28 slots in enclosure cover
29 insulator panel
30 stand offs
32 enclosure
34 holes for LEDs
35 light pipes
36 gear box cover
38 lifting plate
40 transfer gear housing base
42 motor housing
43 motor drive shaft
44 motor mounting flange
46 O-ring
48 motor fan
50 fan housing
52 pinion
54 transfer gear
56 gear box drive gear
58 spindle
60 inner bearing retainer
62 inner support bushing
64 downwardly extending portion of gear box support flange
66 gear box support flange
68 slip ring outer support bushing
70 slip ring inner plate
74 compression springs
76 detent balls
78 ring gear housing
80 first stage ring gear
82 external O-ring
84 gear box housing
86 first stage thrust washer
88 first stage planet gears
90 first stage planet gear carrier
92 first stage sun gear
94 second stage planet gears
96 second stage thrust washer
98 second stage carrier
100 second stage sun gear
102 third stage planet gears
104 third stage carrier
106 third stage sun gear
108 spiral retaining ring
110 first fourth stage carrier ring
112 second fourth stage carrier ring
114 fourth stage carrier
116 fourth stage planet gears
118 drive member
120 fourth stage thrust washer
122 fourth stage ring gear
124 reaction bar
126 reaction spline
128 strain gauges/transducer Although certain embodiments have been illustrated and described herein, it will be appreciated by those of ordinary skill in the art that a wide variety of alternate and/or equivalent embodiments or implementations calculated to achieve the same purposes may be substituted for the embodiments shown and described without departing from the scope. Those with skill in the art will readily appreciate that embodiments may be implemented in a very wide variety of ways. This application is intended to cover any adaptations or variations of the embodiments discussed herein. Therefore, it is manifestly intended that embodiments be limited only by the claims and the equivalents thereof.

What is claimed is:

1. An apparatus for precisely measuring and applying torque and angle of rotation to tighten screwed fasteners, comprising:

a drive motor for generating a rotation;

a pair of spaced triggers for activating the operation of the drive motor;

a controller for precisely measuring the torque to be applied and angle of rotation to be achieved by the apparatus, the controller not permitting the motor to be activated without both of the triggers being activated; and a reduction gear system for reducing a rate of rotation generated by the motor, the reduction gear system outputting a rotational drive torque for driving the screwed fastener.

2. The apparatus of claim 1, wherein each of the two triggers is disposed on one of two drive handles.

3. The apparatus of claim 2, wherein the two drive handles are generally vertically-extending.

4. The apparatus of claim 3, wherein the reduction gear system includes at least one generally laterally extending transfer gear and a generally vertically-extending planetary gear system.

5. The apparatus of claim 1 wherein the triggers are activated by being contacted by the hands of an operator.

6. An apparatus for precisely measuring and applying torque and angle of rotation to tighten screwed fasteners, comprising:

a drive motor including a substantially vertically-extending drive motor drive member, a pair of spaced handles mounted to two sides of the drive motor;

a laterally-extending geared portion drivingly connected to the drive motor drive member for reducing a rate of rotation and including a generally vertically-extending gear drive member; and a generally vertically-extending planetary reduction gear receiving a rotational drive from the gear drive member and outputting a slower drive for driving the screw fastener.

7. The apparatus of claim 6, wherein the apparatus is generally U-shaped, with the drive motor and the reduction gear making up legs of the U and the geared portion making up a connector for the legs.

8. The apparatus of claim 7, wherein the apparatus is generally in the shape of an inverted U.

9. The apparatus of claim 6, wherein the handles extend in a generally vertical direction.

10. The apparatus of claim 6, wherein the apparatus provides a 17,000 Nm drive.

11. The apparatus of claim 6, wherein the apparatus provides a 12,000 Nm drive.

* * * * *